US009793101B2

(12) United States Patent
Makarov

(10) Patent No.: US 9,793,101 B2
(45) Date of Patent: Oct. 17, 2017

(54) METHOD AND APPARATUS FOR INJECTION OF IONS INTO AN ELECTROSTATIC ION TRAP

(71) Applicant: Thermo Fisher Scientific (Bremen) GmbH, Bremen (DE)

(72) Inventor: Alexander A. Makarov, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 15/145,638

(22) Filed: May 3, 2016

(65) Prior Publication Data

US 2016/0329204 A1 Nov. 10, 2016

(30) Foreign Application Priority Data

May 5, 2015 (GB) ..... 1507653.2

(51) Int. Cl.
*H01J 49/42* (2006.01)
*H01J 49/06* (2006.01)

(52) U.S. Cl.
CPC ..... *H01J 49/4245* (2013.01); *H01J 49/062* (2013.01); *H01J 49/4295* (2013.01)

(58) Field of Classification Search
CPC .... H01J 49/0027; H01J 49/0031; H01J 49/06; H01J 49/062; H01J 49/42; H01J 49/4225; H01J 49/4245
See application file for complete search history.

(56) References Cited

U.S. PATENT DOCUMENTS

| | | | | |
|---|---|---|---|---|
| 6,872,938 | B2 | 3/2005 | Makarov et al. | |
| 6,888,130 | B1 | 5/2005 | Gonin | |
| 7,425,699 | B2 | 9/2008 | Makarov et al. | |
| 7,498,571 | B2 | 3/2009 | Makarov et al. | |
| 7,582,864 | B2 | 9/2009 | Verentchikov | |
| 8,796,619 | B1 * | 8/2014 | Doroshenko ..... | H01J 3/40 250/281 |
| 8,901,491 | B2 | 12/2014 | Brekenfeld et al. | |
| 8,907,271 | B2 | 12/2014 | Koster | |
| 2011/0042562 | A1 | 2/2011 | Koster | |
| 2014/0008533 | A1 * | 1/2014 | Brekenfeld ..... | H01J 49/424 250/288 |
| 2014/0138532 | A1 | 5/2014 | Makarov et al. | |

FOREIGN PATENT DOCUMENTS

| | | | |
|---|---|---|---|
| WO | 2004/027764 | A2 | 3/2007 |
| WO | 2008/063497 | A2 | 5/2008 |
| WO | 2011/086430 | A1 | 7/2011 |
| WO | 2012/092457 | A1 | 7/2012 |

* cited by examiner

*Primary Examiner* — David E Smith
(74) *Attorney, Agent, or Firm* — David A. Schell

(57) ABSTRACT

A method of injecting ions into an electrostatic trap, comprising: generating ions in an ion source; transporting the ions from the ion source to an ion store downstream of the ion source; releasing the ions from the ion store to an ion guide downstream of the ion store; and accelerating the ions from the ion guide as a pulse into an orbital electrostatic trap for mass analysis, wherein the average velocity of the ions as the ions exit from the ion guide is substantially higher than the average velocity of the ions as they exit from the ion store, wherein there is a delay between releasing the ions from the ion store and accelerating the ions from the ion guide. Also an apparatus suitable for the method.

23 Claims, 2 Drawing Sheets

METHOD AND APPARATUS FOR INJECTION OF IONS INTO AN ELECTROSTATIC ION TRAP

FIELD

The invention relates to the field of mass spectrometry. In particular, the invention relates to the injection of ions into an electrostatic ion trap (EST). The invention provides both methods and apparatus relating to such ion injection.

BACKGROUND

An electrostatic ion trap, herein simply termed an electrostatic trap (EST), employs an electrostatic field to trap ions. Examples of ESTs include the Kingdon trap, Knight trap and the commercial ORBITRAP™ mass analyzer. Other examples of ESTs include numerous types of reflectron electrostatic ion trap including those of planar geometry, or ESTs having a 'racetrack' configuration wherein ions are deflected around a circuit multiple times. ESTs are increasingly being employed in mass spectrometry as high-resolution, accurate-mass (HRAM) analysers, as evidenced by the dramatic rise of instrumentation based on the ORBITRAP mass analyzer. Oscillations of the ions trapped in the EST are detected and the oscillation frequencies and/or mass-to-charge ratios (m/z) of the ions are determined, for example by Fourier transformation.

A particular challenge associated with ESTs is the effective injection of ions into the EST. The ORBITRAP mass analyzer utilizes an RF-only straight or curved linear trap (the latter being termed a C-trap) as an ion storage device from which ions are injected into the EST, as described in U.S. Pat. No. 6,872,938. The linear trap is operated to provide pulsed injection of ions into the EST and is implemented using circuitry as described in U.S. Pat. No. 7,498,571. Axial or radial ejection of ions from the linear trap are possible, with radial ejection tending to provide better spatial focusing of ions into the EST in practice. In U.S. Pat. No. 7,425,699 is described an embodiment of ion injection having a so-called liner downstream of a pulsed ion trap that is used for energy lifting but it does not function as an ion guide as it does not have any field inside. Furthermore, the liner does not produce time-of-flight focusing or bunching of ions.

In U.S. Pat. No. 8,796,619 is described an ion injection system for an orbital trapping EST in which ions are released from an ion storage device via a pulsed ion extraction lens. However, there is no separation in time between release of ions from the ion storage device and applying the extraction voltage pulse and the system does not produce a temporal compression of ions upon injection.

Other methods of ion injection have been proposed for use with an EST, such as injection from an orthogonal accelerator (U.S. Pat. No. 6,888,130), injection from a 3D ion trap (U.S. Pat. No. 8,901,491), injection from a gas-filled linear trap with a subsequent orthogonal acceleration from an RF ion guide (WO 2011/086430) and injection via a Kingdon ion guide located in a drill-hole in the wall of a Kingdon ion trap (U.S. Pat. No. 8,907,271).

Another proposed approach is to provide continuous ion injection into the EST with subsequent excitation as described in WO 2008/063497 and WO 2012/092457.

Further approaches envisaged could include mass-dependent ejection from an ion trap as described in WO 2007/027764 and in U.S. Pat. No. 7,582,864, in which an unbalanced linear trap with axial ejection could be combined with an orthogonal accelerator.

It is noted that all methods employing direct ejection from a gas-filled trap to an EST tend to suffer from fragmentation of large molecular ions (e.g. proteins) during ion extraction from the trap. Furthermore, there is a need to provide effective differential pumping in a small space to prevent gas carryover to the EST.

It is therefore desirable to avoid these disadvantages when injecting ions into an EST.

SUMMARY

According to one aspect of the invention there is provided a method of injecting ions into an electrostatic trap, comprising:

generating ions in an ion source;

transporting the ions from the ion source to an ion store downstream of the ion source;

releasing the ions from the ion store to an ion guide downstream of the ion store; and accelerating the ions from the ion guide into an electrostatic trap.

After releasing the ions into the ion guide, the ions remain in the ion guide for a period until the ions are accelerated out of the ion guide into the EST, i.e. there is a delay between release of the ions from the ion store into the ion guide and acceleration of the ions from the ion guide. The ions are accelerated from the ion guide into the electrostatic trap for mass analysis. Preferably, the average velocity of the ions as the ions exit from the ion guide is substantially higher than the average velocity of the ions as they exit from the ion store. The average ion velocity of the ions at the exit from the ion guide is preferably at least 1.5 times higher, or at least 2 times higher, or at least 5 times higher, or at least 10 times higher than the average ion velocity as they exit from the ion store.

Once the ions are in the electrostatic trap (EST), it will be appreciated that a method of mass spectrometry may be performed by mass analysing the ions in the electrostatic trap, for example to produce a mass spectrum. The method thus comprises: generating ions in an ion source; transporting the ions from the ion source to an ion store downstream of the ion source; releasing the ions from the ion store to an ion guide downstream of the ion store; accelerating the ions from the ion guide into an EST; and mass analysing the ions in the EST.

The invention also provides apparatus for performing the method.

In another aspect, the invention provides an apparatus for injecting ions into an electrostatic trap, comprising:

an ion source for generating ions;

an ion store downstream of the ion source for receiving ions that have been generated in the ion source; and an ion guide downstream of the ion store for receiving ions that have been released by the ion store and for accelerating the received ions into an electrostatic trap downstream of the ion guide;

wherein for accelerating the ions the ion guide is provided with a pulser configured to provide a voltage pulse in the ion guide for increasing the average velocity of the ions at the exit of the ion guide from the average velocity of the ions at the entrance to the ion guide. The ion store is preferably configured to slowly release the ions to the ion guide. There is preferably a delay between releasing the ions into the ion guide and providing the voltage pulse to the ion guide for accelerating the ions out of the ion guide to the EST.

In still another aspect, the invention provides an apparatus for injecting ions into an electrostatic trap, comprising:

an ion source for generating ions;

an ion store downstream of the ion source for receiving ions that have been generated in the ion source;

an ion guide downstream of the ion store for receiving ions that have been released by the ion store and for accelerating the received ions into an electrostatic trap downstream of the ion guide; and a pulser configured to provide a voltage pulse in the ion guide for increasing the average velocity of the ions at the exit of the ion guide compared to the average velocity of the ions at the entrance to the ion guide;

wherein accelerating the ions into the electrostatic trap takes place in the same direction as the release of ions from the ion store, which is substantially orthogonal to a direction of mass separation, z, in the electrostatic trap.

In yet another aspect, the invention provides an apparatus for injecting ions into an electrostatic trap, comprising:

an ion source for generating ions;

an ion store downstream of the ion source for receiving ions that have been generated in the ion source; and a helical trajectory ion guide downstream of the ion store for receiving ions that have been released by the ion store and for accelerating the received ions into an electrostatic trap downstream of the ion guide;

wherein accelerating the ions into the electrostatic trap takes place substantially orthogonally to the direction of the release of ions from the ion store and substantially parallel to a direction of mass separation, z, in the electrostatic trap. For this aspect as well, the ion guide is preferably provided with a pulser configured to provide a voltage pulse in the ion guide for increasing the average velocity of the ions at the exit of the ion guide from the average velocity of the ions at the entrance to the ion guide. The ion store is preferably configured to slowly release the ions to the ion guide. There is preferably a delay between releasing the ions into the helical ion guide and providing the voltage pulse to the helical ion guide for accelerating the ions out of the ion guide to the EST.

In a further aspect, the invention provides a mass spectrometer for mass analysing ions comprising the apparatus for injecting ions and an electrostatic trap for receiving the ions accelerated by the ion guide and mass analysing the ions.

The EST is preferably an orbital EST, such as an ORBITRAP mass analyzer.

Numerous preferred features of the invention are described in the appended claims.

Further features of the invention will now be described, including preferred embodiments for implementing the invention.

The invention avoids fragmentation of large molecular ions during ion extraction from a gas-filled ion trap to an EST and the problem of gas carryover, at the same time providing necessary injection conditions (e.g. focused, coherent ion packets) for high-performance analysis in an EST. The reduced fragmentation of molecular ions is attributed to a gentler extraction from gas-filled storage into an evacuated ion guide which bunches the ions and focuses the ions into an EST by a delayed pulsed acceleration after the release of the ions into the ion guide from the ion store. The invention can be implemented using generally slower electronics and smaller voltage pulses than the prior art. A simplified differential pumping arrangement is made possible due to the geometry between injection device and the EST not being as tight as the prior art.

The electrostatic trap may be any of the ESTs described above, e.g. orbital EST or reflectron EST (including those with planar mirrors) or racetrack EST, but in particular is an orbital electrostatic trap, such as a Kingdon trap, ORBITRAP mass analyzer, or an EST as described herein. An orbital EST is an EST in which ions oscillate (i.e. execute back and forth motion) in the direction of a longitudinal axis z of the EST while simultaneously undergoing orbital motion (typically orbiting about the longitudinal axis z) preferably about one or more inner electrodes of the EST (as in the ORBITRAP mass analyzer for example) or while simultaneously undergoing radial motion in a gap between two or more inner electrodes of the EST (as in a Cassinian trap for example). The ions separate in the direction of the longitudinal axis z according to their m/z since their longitudinal oscillation frequency (i.e. along z) depends upon their m/z. The EST comprises one or more detection electrodes to detect the ion oscillations within the EST. Orbital ESTs may comprise a single inner electrode (e.g. spindle shaped as in an ORBITRAP mass analyzer) or may comprise multiple inner electrodes (e.g. as described in U.S. Pat. No. 7,994,473 (Köster)). The EST may be one described in U.S. Pat. No. 7,994,473 and in C. Köster, Int. J. Mass Spectrom. Vol. 287, pages 114-118, 2009 (termed Cassinian trap). Further features of the invention will be illustrated with examples of an orbital EST, in particular an ORBITRAP mass analyzer, but it should be understood that the invention is not limited to such examples. The invention does, however, have particular applicability in the injection of ions into an orbital EST, such as an ORBITRAP mass analyzer, Kingdon trap or Cassinian trap for example.

The ions are generated in an ion source as known in the art. The nature of the ion source is not particularly limited and suitably any known source for mass spectrometry may be used. The ion source may be a continuous or pulsed ion source. In particular, the ion source may be an atmospheric pressure ion (API) source. The ion source may be an electrospray ion source or a MALDI ion source for example. The ions may be secondary ions generated in a SIMS ion source. The generated ions generally have a range of m/z as they are to be injected into the EST for mass analysis.

The ions may be transported directly from the ion source into the ion store or, more preferably, the ions may be transported downstream from the ion source via at least one ion optical device located upstream from the ion store (i.e. located intermediate between the ion source and the ion store). Examples of different configurations of upstream ion optical device may include the following arrangements. In certain embodiments, the ions generated in the ion source may be transported to the ion store by at least one upstream ion guide located between the ion source and the ion store. The at least one upstream ion guide may comprise at least one multipole ion guide and/or at least one stacked ring ion guide (SRIG). For example, a SRIG may capture ions from the ion source and transport the ions to one or more multipole ion guides which in turn may transport the ions to the ion store. Alternatively, a multipole ion guide (e.g. quadrupole, hexapole or octapole) may capture ions from the ion source and transport the ions to one or more further multipole ion guides, which in turn may transport the ions to the ion store.

The ions may be subject to separation upstream of the ion store according to one or more physicochemical properties (e.g. mass, m/z, ion mobility etc.). The ions may be subject to one or more stages of mass analysis prior to entering the ion store. The following embodiments could be employed so that ions are delivered to the ion store from a preceding stage of mass analysis or filtering. A mass filter may be provided upstream of the ion store (i.e. located intermediate between the ion source and the ion store) so that the ions may be mass filtered, i.e. restricted in their m/z range, before being stored in the ion store. In this way, only selected ions of interest may enter and be stored in the ion store. The mass filter may be a quadrupole mass filter, or mass resolving ion trap, as known in the art. In addition or alternatively, the ions may be subject to separation in an ion mobility separator (IMS) located upstream of the ion store. The IMS may be located upstream or downstream of the mass filter where present. A collision cell may be located upstream of the ion store to enable $MS^2$ methods.

The ion store may be any suitable ion storage device. The ion store may be a linear or 3D ion trap. The ion trap may be a multipole, especially quadrupole, ion trap, i.e. a linear quadrupole (2D) ion trap or 3D quadrupole ion trap. The ion store may be configured with a plurality of parallel ring electrodes spaced apart in an axial direction of the ion store, e.g. with RF applied. The ion store may be an ion trap, e.g. as aforementioned, that is an RF-only ion trap. In a particularly preferred embodiment the ion store is an RF ion trap, especially an RF linear ion trap.

In some embodiments, the ion store may be configured as a collision cell to fragment the ions that enter the ion store. The ion fragments may then be released to the ion guide for subsequent ejection to the EST.

The ions are preferably stored in the ion store until they are required to be released to the ion guide. The residence time of the ions in the ion store is typically in the range from 500 microseconds to 10 milliseconds. The ion store preferably contains a gas to assist storing the ions. Suitable gases may be nitrogen, argon, or helium, with the choice of gas being depending on the nature of the ions to be stored as known in the art. The ions are preferably cooled in the ion store, i.e. to reduce their energy, by collisions with the gas. The ions are preferably stored in the ion store for a period sufficient to allow the ions to cool to the desired degree. Preferably, the pressure in the gas-filled ion store is in the range from about $5\times10^{-4}$ mbar to about $1\times10^{-2}$ mbar, more preferably from about $1\times10^{-3}$ mbar to about $1\times10^{-2}$ mbar, and most preferably from $1\times10^{-3}$ mbar to $5\times10^{-3}$ mbar.

The ions are preferably slowly released from the ion store to the ion guide, for example at energies less than 1V. The ions are preferably released over hundreds of microseconds. The ions are preferably released such that the time to empty the ion store of all ions takes at least 10 microseconds, or at least 20 microseconds, or at least 50 microseconds, but preferably takes less than 1000 microseconds, or less than 500 microseconds, or less than 200 microseconds or less than 100 microseconds. For example, the time to empty the ion store of all ions may be in the range 10 to 1000 microseconds, or 10 to 500 microseconds, or 10 to 200 microseconds, or 10 to 100 microseconds, or 20 to 1000 microseconds, or 20 to 500 microseconds, or 20 to 200 microseconds, or 20 to 100 microseconds, or 50 to 1000 microseconds, or 50 to 500 microseconds, or 50 to 200 microseconds, or 50 to 100 microseconds, or 100 to 1000 microseconds, or 100 to 500 microseconds, or 100 to 200 microseconds. A preferred time range for release of ions is 10 to 100 microseconds.

Time dependent voltages are preferably applied to the ion store to release the ions to the ion guide. The ions are preferably released from the ion store by applying an axial DC electric field gradient within the ion store, e.g. in the range of 0.1-10 V/m, i.e. in the axial direction of the ion store. The axial field gradient is preferably applied for a period as described above for emptying the ion store of ions, i.e. a DC voltage is applied as a pulse for the appropriate period. The axial DC field is generally provided via electrodes and may be provided as known in the art, e.g. via one or more auxiliary electrodes (e.g. external but adjacent to the ion store) or by configuring the ion store with segmented (RF) electrodes and applying DC voltage to the segments e.g. via a resistive divider.

As described, the ions are released slowly from the ion store to an ion guide for accelerating the ions into the EST. The ion guide is preferably located immediately downstream of the ion store in order to minimise the distance between them. The ion guide is preferably gas-free, in contrast to the preferably gas-filled ion store. Gas-free means that a source of gas is not deliberately admitted into the ion guide. The pressure in the ion guide is thus lower than in the preceding ion store. The pressure in the ion guide is preferably less than, or equal to, $10^{-3}$ mbar, typically in the range $10^{-5}$-$10^{-3}$ mbar. The ion guide is preferably a non-trapping ion guide, i.e. preferably the ions are not axially confined but only radially confined in the ion guide, such that the ion guide is a single-pass ion guide in the axial direction (i.e. without reflection of ions in the axial direction). Accordingly, the residence time of the ions in the ion guide is typically significantly less than the residence time of the ions in the preceding ion store. The residence time of the ions in the ion guide is typically in the range from 10 microseconds to 1000 microseconds.

In general the ion guide is an ion optical device for transporting ions in one direction while limiting their motion in at least one other direction. The ion guide may be an RF ion guide or electrostatic ion guide. The ion guide may be a linear multipole ion guide or stacked ring ion guide for example, preferably an RF multipole or stacked ring ion guide and more preferably a linear RF multipole ion guide. The multipole ion guide may be a quadrupole, hexapole or octapole ion guide for example. The ion guide in another preferred embodiment may be a helical or spiral trajectory ion guide (herein helical ion guide), wherein ions are guided on a helical path about the ion guide axis as they travel through the guide (at either constant or varying distance from the guide axis). Thus, in the helical ion guide, the ions move with both axial and rotational motion. The helical ion guide may comprise a multi-turn electrostatic sector guide e.g. formed of at least a pair of coaxial electrodes. In the case of the helical ion guide it may be necessary to release ions from the ion store into the ion guide in a time period less than 100 microseconds. It is preferred that the ions are accelerated axially from the ion guide. Such axial acceleration from the ion guide may be in a direction that is orthogonal or parallel to the direction of mass separation, z, in the EST, or may be at an angle in-between orthogonal and parallel, as further described hereinafter.

After a time delay once the required ions (i.e. the ions required to be injected into the EST) have begun entering the ion guide from the ion store, preferably a pulsed acceleration of the ions extracts them to the EST. The time delay is typically in the range from 10 microseconds to 100 s of microseconds (for example up to 1000, or up to 900, or up to 800, or up to 700, or up to 600, or up to 500, or up to 400, or up to 300, or up to 200, or up to 100 microseconds). This time delay should be long enough to allow ions to completely leave ion store but still short enough to avoid ion losses due to reaching the exit from the ion guide. Preferably, the time delay should not exceed 90% of the time-of-flight through the ion guide for the ions of the lowest m/z of interest. Typically, this time-of-flight is shorter for the guide of FIG. 2 comparing to the guide of FIG. 1. On the lower end, delay is limited by the speed of ion extraction from the ion store which is regulated by the strength of extraction electric field. This strength (and hence speed of extraction) is limited by undesired fragmentation of ions as they are pulled through the gas within the ion store. Thus, the ions are extracted or ejected from the ion guide in a pulsed manner (toward the EST). For this purpose, an axial DC electric field gradient, preferably in the range of $10^3$-$10^4$ V/m, is preferably applied within the ion guide so that the energy increase of the ions depends on their initial positions within the guide (i.e. their positions within the guide when the DC field is first applied). In this way, ions are accelerated out of the ion guide to the EST as a pulse and for ions of any given m/z the packet of such ions is substantially shorter (in time or space) at the exit of the ion guide than at the entrance of the guide. Moreover, the average ion velocity of the ions at the exit from the ion guide is substantially higher than the average ion velocity at the entrance to the ion guide. The term velocity herein is used according to its generally meaning, that is it means speed or absolute velocity, unless a direction of motion is indicated. Accordingly, the term average ion velocity means the average ion speed or absolute velocity. Preferably, the average ion velocity of the ions at the exit from the ion guide is at least 1.5 times higher, or at least 2 times higher, or at least 5 times higher, or at least 10 times higher than the average ion velocity at the entrance to the ion guide. Importantly, the duration of each ion packet (i.e. of each m/z) as the packet enters the EST is substantially shorter than when the packet of ions enters the ion guide.

Preferably, at the same time as applying the axial DC field gradient, the (or any) RF field is switched off. The axial DC field gradient is preferably applied as a pulse (i.e. by applying a DC voltage pulse) from a pulser. The pulser may comprise any suitable pulsing electronics known in the art, such as MOSFET transistors. The rise-time of the axial DC field gradient is preferably in the range of 10-1000 nanoseconds. The DC field in the ion guide is generally provided via electrodes, i.e. preferably connected to the pulser. The axial DC field gradient may be provided from the pulser via one or more auxiliary electrodes (e.g. external but adjacent to the ion guide) or by configuring the ion guide with segmented (RF) electrodes and applying DC to the segments e.g. via a resistive divider as known in the art. The ions are preferably accelerated from the ion guide with energies in the range from 1% to 30% of the final ion energy in the EST. Higher energies are possible but are preferably avoided to minimise ion losses. For example, if the final energy of the ions in the EST is in the range 2 to 4 kV, which is typical for an ORBITRAP mass analyzer, then the ions are preferably accelerated from the ion guide with energies in the range up to about 1200 V (or up to about 1000 V), e.g. 1 V to 1200 V or 1 V to 1000 V, more typically 50 to 1200 V or 100 to 1000V, more preferably 200 to 1000 V, most preferably 500 to 1000 V, before reaching final energy in the EST.

Preferably, the energy spread of the ions accelerated by the ion guide is significantly smaller than the final energy of the ions within the EST. More preferably, the energy spread of the ions is not more than 10-30%, e.g. not more than 10% or not more than 20% or not than 30%, of the final energy of the ions within the EST.

The ion guide accelerates the ions towards the EST and focuses the ions at the desired location, e.g. at the entrance to the EST or within the EST. Preferably, the actual location of the minimum spread of the time-of-flight of ions (i.e. the focal point) is adjusted to reside inside the EST. Additional ion optics, such as an ion lens for example, may be employed downstream of the ion guide to adjust the position of the focal point of the ions.

In the ion guide the ions preferably move with an initial velocity in the z-direction (i.e. prior to acceleration) that is substantially smaller than the velocity in the z-direction during ion detection in the EST, until ions receive pulsed acceleration towards the EST. In one type of embodiment, the ion guide axis x (i.e. in its axial direction) is aligned substantially orthogonally to the direction of mass separation, z, in the EST (herein also termed the longitudinal direction or axis of the EST) and an example of this type utilises an RF linear ion guide. In another type of embodiment, the ion guide axis is aligned substantially parallel to the direction of mass separation, z, in the EST) and an example of this other type utilises a helical ion guide. In both cases, the initial velocity in the z-direction prior to acceleration remains small relatively to the final total velocity.

The release of ions from the ion store is preferably in a direction substantially orthogonal to direction z. Extraction of the ions from the ion guide to the EST may be implemented in a number of preferred ways. Preferably, the (pulsed) acceleration from the ion guide is applied:

a) in the same direction as the release of ions from the ion store, which is also substantially orthogonal to z (e.g. where the ion guide is a RF linear ion guide); or
b) substantially orthogonally to the direction of ion release from the ion store and substantially parallel to z.

In the embodiments using a helical ion guide, there may be a potential step within the ion guide that reduces the velocity of the ions in the z direction of the EST, preferably without affecting their rotational motion. Preferably, the step (i.e. pitch) of the helix is reduced within the ion guide to lie in the range 1-2 times the beam diameter. The helical ion guide is preferably arranged with its axis in the same direction (i.e. parallel) and preferably coaxial with the direction of mass separation, i.e. z-axis, of the EST. The ions may be accelerated out of the helical ion guide at a fixed radius in the axial direction (i.e. preferably in the z direction of the EST). That is, the ions may be accelerated out of the helical ion guide at a fixed radius relative to the ion guide axis, which is preferably also in the direction or axis z. The ions are preferably accelerated out of the helical ion guide by applying a DC pulse to generate an axial field gradient as described above. The pulsed acceleration of ions from the helical ion guide preferably is substantially orthogonal to the direction of extraction from the ion store and parallel to z. The DC pulse preferably accelerates the ions towards the centre of the EST, whereby the ions become bunched into a shorter packet, i.e. ions of each m/z get bunched into a shorter packet. After accelerating all required ions out of the helical ion guide, a further DC axial field gradient may be applied in the ion guide (preferably different to, more preferably higher gradient than, the first DC axial field gradient) that stays on whilst ions are being detected in the EST, i.e. during the duration of detection of ions in the EST. The further DC axial field is preferably chosen such that perturbations of the ideal electric field within the EST (i.e. in the space of ion motion) are minimised. In this way, the ions are forced to continue oscillating harmonically along z within the EST (or at least deviations from harmonic motion are thereby minimised so that ion oscillations within the EST in the direction z remain as close to harmonic as possible).

Once the population of ions has left the ion store (and entered the ion guide), the voltage pulse applied to the ion guide to accelerate the ions out of the guide causes the ions to become bunched (focused) into packets that are sufficiently narrow in the z-direction of the EST when they pass near one or more detection electrodes of the EST so as to maintain coherence of the ion packets during detection in the EST (and reduce dephasing). In respect of each m/z the ions are preferably focused to form an ion packet. The DC axial field pulse may provide a linear potential distribution in the ion guide or a higher order potential distribution (e.g. quadratic potential distribution). In the case of a linear potential distribution, optimum bunching of the ions from the centre of the ion guide to any desired point downstream of the guide generally takes place if the time-of-flight of ions to that point from the exit of the guide ($x=x_0$) is substantially equal to the time-of-flight of ions from the ion beam centre ($x_c$) to $x_0$. Generally, the potential distribution in guide may be given by $U=C*(x-x_0)^n$ where C is a constant, x is the position along the ion guide axis ($x_0$ being the exit of the guide) and n is an integer. The case of a linear potential distribution corresponds to n=1. Where n>1 it results in a relatively shorter time-of-flight after $x_0$ and where n<1 it results in a relatively longer TOF after $x_0$.

A carryover of gas from the ion store to the EST may be avoided or reduced by providing a small bend in the ion beam prior to the EST, thereby separating it from the gas beam.

It can be seen that prior to injection into an EST that measures ion separation along direction z (according to m/z of the ions), ions are released from a storage device into an ion guide where the ions move with a low velocity in direction z before receiving pulsed acceleration that injects them into the electrostatic trap as a short ion packet in direction z.

After injection of the ions into the EST by acceleration from the ion guide, the ions oscillate in the EST and the EST detects the ion motion along direction z and measures the mass-to-charge ratio (m/z) based on the ion motion along direction z.

DESCRIPTION OF PREFERRED EMBODIMENTS

In order to enable a more detailed understanding of the invention, numerous embodiments will now be described by way of example and with reference to the accompanying drawings.

In a first type of embodiment, it is preferred to store ions in a gas-filled linear trap and then release the ions as a slow stream into an RF or electrostatic ion guide preferably orthogonally to the direction z of ion dispersion in the EST (i.e. the direction along which ions are separated according to m/z in the EST). Once the ion population has left the trap, an electrical pulse is applied to the guide so that the ions become bunched into packets that are sufficiently narrow in direction z when they pass near to the detection electrode(s) of the EST.

Figure 1:
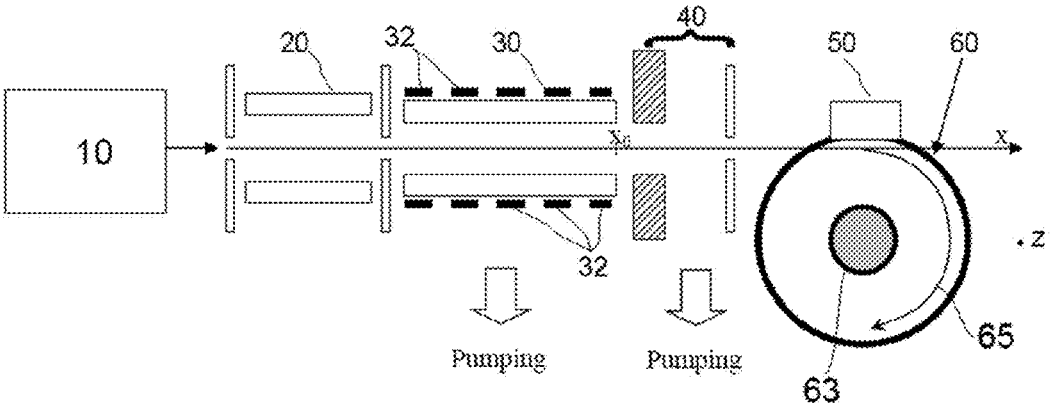
FIG. 1 shows schematically a first embodiment of the invention employing an RF linear ion guide to inject ions into an EST.

Referring to FIG. 1, there is shown schematically a first preferred embodiment with linear ion store/ion guide geometry. The ions are introduced from an ion source or previous stage of mass analysis 10 into an ion storage device 20, which is preferably an RF-only linear ion trap. This trap is filled with gas such as nitrogen or argon at pressures preferably from $1\times10^{-3}$ to $5\times10^{-3}$ mbar. Once the required ion population is stored in trap 20, the ions are slowly released, typically on the timescale of hundreds of microseconds, with the use of an axial field gradient within the trap 20 into an RF-only linear ion guide 30. The ions are preferably released from the trap 20 into the linear guide 30 at energies less than 1 V.

Once all ions of m/z of interest have entered the linear guide 30, i.e. after a time delay following their slow release from the ion store, the RF field is preferably switched off in the guide 30 and a pulser (not shown) provides that an axial electric field pulse is applied to the guide to pulse the ions out of the guide 30 into the EST 60 wherein the ions are increased in energy dependent on their initial positions within the guide. Thus, the average velocity of the ions as the ions exit from the ion guide is substantially higher than the average of the ions velocity as they enter the ion guide. A DC axial electric field gradient may be created by use of external, auxiliary electrodes, i.e. outside the guide, e.g. which may be angled to the ion guide axis or segmented in the direction of the ion guide axis, or by arranging the RF linear guide 30 to have multipole electrodes comprising multiple segments. The voltage pulse from the pulser could be fed to all segments of the electrodes via a capacitive or capacitive/resistive divider as known in the art. In the embodiment shown, segmented auxiliary electrodes 32 provide the axial field gradient.

The axial electric field gradient provides focusing of the ions to the entrance of an EST 60 of orbital type, such as an ORBITRAP mass analyzer. Importantly, for ions of the same m/z that form a respective ion packet, the duration of the ion packet (i.e. of each packet of a particular m/z) as the packet enters the EST is substantially shorter than when the packet of ions enters the ion guide after release from the ion store. The spatial divergence of the ions in radial direction is compensated by ion optics 40 comprising a lens. The ion injection is finally facilitated by use of ion deflector 50 so that ions commence their orbital flight 65 within the EST about central electrode 63 whilst oscillating back and forth in the direction z, which is perpendicular to the plane of the page. The ions disperse according to their m/z along the direction z, since ions of different m/z have different oscillation frequencies in direction z.

It can be seen from FIG. 1 that in the first preferred embodiment the release of ions from the ion trap 20 is in a direction x orthogonal to direction z and the pulsed extraction of the ions from the ion guide 30 to the EST 60 is in the same direction x as the release of ions from the ion trap 20, i.e. orthogonal to z.

Direct line-of-sight gas carryover from the ion trap 20 to the EST 60 can be avoided by introducing a slight bend of the ion beam by the ion optics 40, thereby separating the ion beam from the gas stream. Furthermore, the ion guide 30 and ion optics 40 may be housed in regions subject to differential pumping.

In the case of a linear potential distribution in ion guide 30 for accelerating the ions, optimum bunching from the centre of the guide to any desired point downstream takes place if the time-of-flight (TOF) to that point from the exit of the guide ($x=x_0$) is substantially equal to the TOF from the ion beam centre to $x_0$. Generally, the potential distribution in guide 30 is given by $U=C*(x-x_0)^n$, where C is a constant, x is the axial position in the ion guide and n is an integer. The case of linear potential corresponds to n=1. The case of n>1 would result in a relatively shorter TOF after $x_0$ and n<1 in would result in a relatively longer TOF.

By providing acceleration in optics 40, the actual location of the minimum spread of TOFs (i.e. focal point) can be adjusted to reside inside the EST 60. Generally, the energy spread introduced within the guide 30 should be significantly smaller than the final energy of ions within the EST, preferably not more than 10-30% of the final energy. In practice, ion guide 30 is typically 0.05 to 0.2 m long for an EST with axial amplitude of ion oscillations during detection of 5-10 mm.

For a standard ORBITRAP mass analyzer having two detection electrodes, the preferred location of the focal point for the ions is near the centre of the EST. If ions are excited by injection at coordinate z=h (typically the axial amplitude of ion oscillations during detection), as described in U.S. Pat. No. 7,714,283, there is an additional effective path length ΔL given approximately by $$\Delta L = h\frac{\pi}{2}\frac{\omega_\varphi}{\omega}$$

where $\omega_\Phi$ is the angular velocity of rotation and ω the angular velocity of axial oscillations. Where multiple detection electrodes are used, as shown in FIGS. 5-7 of U.S. Pat. No. 7,714,283 for example, the energy spread introduced within the ion guide 30 should be sufficiently small to allow limiting the TOF spread of the ions on the way into the EST at a level substantially below the TOF along the length of each of these electrodes (in practical terms, <5-20%). This condition is necessary for the coherence of the ion packets and its violation will lead to a loss of sensitivity and, in some cases, resolution (since it increases the influence of natural decay of the signal on de-phasing of the packets).

Figure 2:
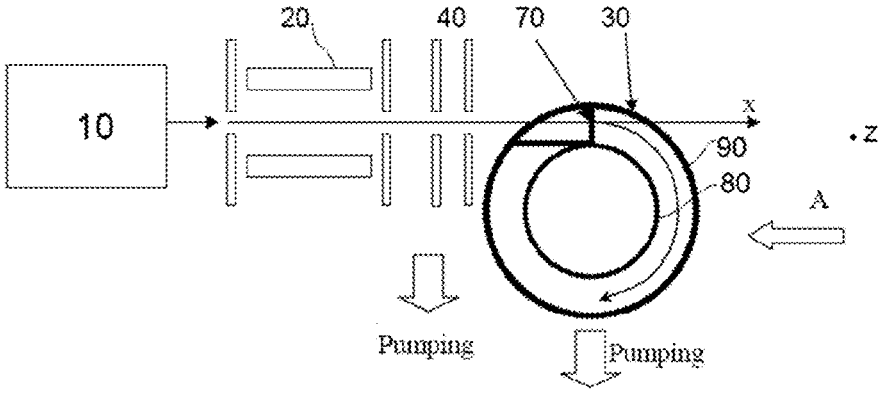
FIG. 2 shows schematically a second embodiment of the invention employing a helical means for injecting ions into an EST.
Figure 3:
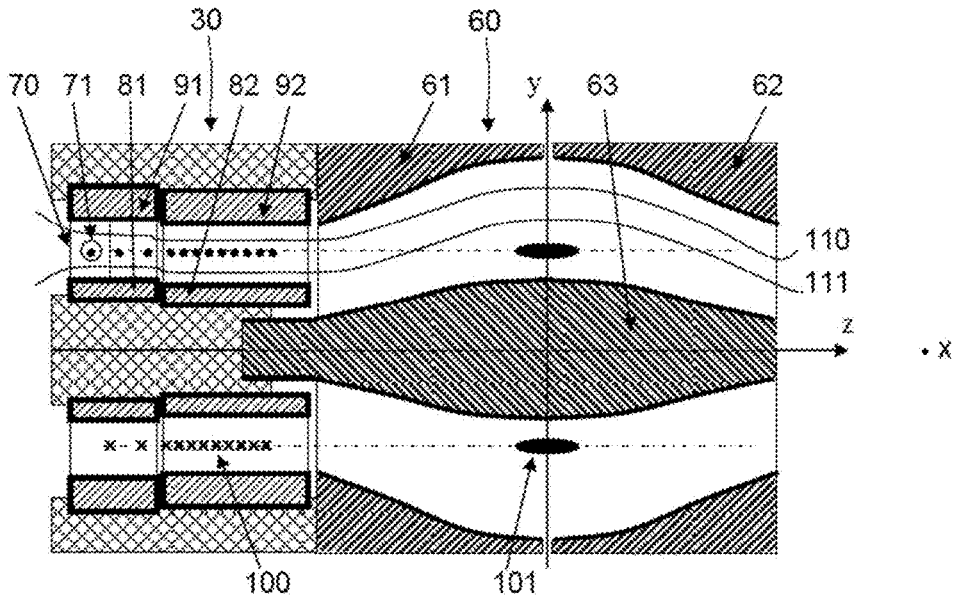
FIG. 3 shows schematically a cross sectional view of the ion guide in the FIG. 2 embodiment looking in the direction of the arrow A shown in FIG. 2 with the EST visible.

FIG. 2 shows a second preferred embodiment of a helical motion type of ion injection, wherein the ion guide 30 in this case is a multi-turn electrostatic sector located external to the EST 60. FIG. 3 shows schematically a cross sectional view of the ion guide in the FIG. 2 embodiment looking in the direction of the arrow A. Generally, the same or similar components in FIGS. 2 and 3 are given the same numerals as in FIG. 1. Referring to both FIGS. 2 and 3, the guide 30 comprises a pair of coaxial electrode sets 80 and 90 generally of cylindrical form. As shown in FIG. 3, each of the electrode sets contains at least two electrodes, 81/82 and 91/92, respectively. The at least two electrodes, 81/82 and 91/92, of each electrode set are axially spaced apart. In some other embodiments, more than one pair of coaxial electrode sets may be used. In some other embodiments, more than two electrodes may be used in each electrode set. The guide 30 also comprises an entrance unit 70 through which ions enter guide 30. The entrance unit 70 lies in place of a sector taken out from the outer circular electrode 91 and allows the ion beam to enter the space between electrodes 81 and 91 of the electrode sets via an entrance aperture 71 in unit 70. Unit 70 can be arranged to have field-sustaining elements on its side so as to reduce potential perturbations within the space between the electrode sets.

The ions are released from the ion trap 20 in the same way as in FIG. 1, although it is preferable in this embodiment to complete ejection of ions from the trap 20 in less than 100 microseconds due to the high ion energy in the device 30. As ions enter the space between the electrode sets at a small angle to the axis z, they start to move along a helical or spiral trajectory rotating around the central electrode set 80 with a step that clears them from the side of entrance unit 70 as they complete their first rotation. As the ions proceed to move away from the unit 70, preferably at around 1-2 times the gap between electrodes 81 and 91, they are subjected to a potential step formed between first and second electrodes 81 and 82 of the inner electrode set 80 and between first and second electrodes 91 and 92 of the outer electrode set 90, so that their velocity in direction z becomes reduced without affecting the ions' rotational movement. This is similar to the step described with reference to FIG. 3 of U.S. Pat. No. 5,886,346. This allows reduction of the step or pitch of the ion beam helix dramatically, preferably down to 1-2 times the ion beam diameter, and allows storing many microseconds of duty cycle within just a few millimetres along direction z. This is illustrated in FIG. 3 by ion trajectories 100, where the bold dots illustrate ions flying out of the plane of the drawing and crosses illustrate ions flying into the plane of the drawing.

The exit of the electrostatic sector guide 30 is coupled to the EST 60 which in this case is preferably an ORBITRAP mass analyzer as shown, with two outer detection electrodes 61, 62 and a central spindle-shaped electrode 63. Typical representative equipotentials present in the EST as ions are injected are shown by lines 110 and 111 in FIG. 3 and by line 120 in FIG. 4. It can be seen from FIGS. 2 and 3 that the release of ions from the ion trap 20 in the second preferred embodiment is in a direction x orthogonal to direction z and the pulsed extraction of the ions from the ion guide 30 to the EST 60 is in the direction z, i.e. orthogonally to the direction in which the ions were released from the ion trap 20.

Figure 4:
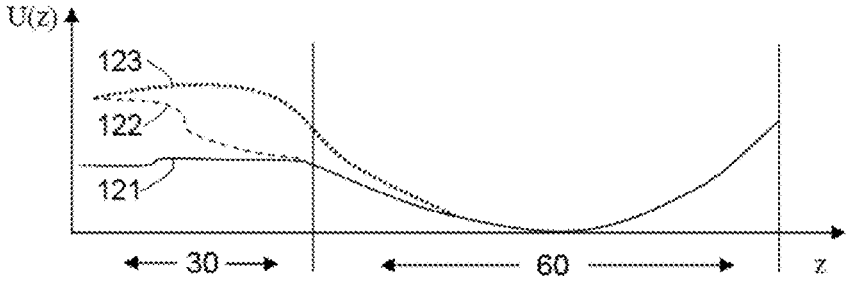
FIG. 4 shows schematically the potential distribution in the FIG. 3 embodiment along the axis z extending over the guide 30 and the EST 60.

Ions are injected into the EST 60 from the electrostatic sector guide 30 not in the trap centre along a tightening radius as described in U.S. Pat. No. 5,886,346, but rather at a fixed radius and only in the axial direction z (the direction of mass separation). This is achieved by applying a voltage pulse to the first electrodes 81 and 91 of each electrode set in FIG. 3 (e.g. a capacitively coupled voltage from an external pulser) so that the potential distribution changes from 121 to 122 as shown in FIG. 4. As the ions start moving towards the centre of the EST (shown by the position of axis y), each m/z gets bunched into a shorter packet 101. By the time the ions return back to the second electrodes 82 and 92 at the end of their first oscillation, the voltage on both electrodes 82 and 92 is changed so that the potential distribution changes again to 123 in FIG. 4 (e.g. again by applying a voltage pulse but in this case a DC-coupled voltage because it needs to stay switched high (on) for the entire duration of ion detection in the EST 60). As the time of the ions' return to guide 30 depends strongly on m/z, a delay of switching the potential to 123 can be used to define the mass range to be trapped in the EST, for example in the simplest case where the maximum m/z to minimum is of the order of about 10 (e.g. the heaviest m/z are approaching the trap centre as the lightest m/z are already returning in the direction towards the guide 30). This mass range may be extended significantly by utilizing synchronised time-dependent voltages on the first electrodes 81/91, and second electrodes 82/92 so that a few percent of voltage change during the injection enables ions of lighter m/z (which reach the gap between those first and second electrodes first) to receive a smaller increase of velocity in the z direction than ions of heavier m/z. The final voltages on electrodes 82 and 92 are chosen in such a way that perturbations of the ideal field in the area of ion motion in the EST are minimised by the potential distribution 123. Therefore, the ions are forced to continue oscillating back and forth in the direction z within the EST (whilst orbiting about central electrode 63) until ion detection has finished, with the bunching into packets enforcing coherence of the axial oscillations along z. In this way, deviations of the ion oscillations from harmonic oscillation are minimised, i.e. ion oscillations in the axial direction z remain as close to harmonic as possible.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance", "such as", "for example" and like language) provided herein, is intended merely to better illustrate the invention and does not indicate a limitation on the scope of the invention unless otherwise claimed. No language in the specification should be construed as indicating any non-claimed element as essential to the practice of the invention.

As used herein, including in the claims, unless the context indicates otherwise, singular forms of the terms herein are to be construed as including the plural form and vice versa. For instance, unless the context indicates otherwise, a singular reference herein including in the claims, such as "a" or "an" means "one or more".

Throughout the description and claims of this specification, the words "comprise", "including", "having" and "contain" and variations of the words, for example "comprising" and "comprises" etc, mean "including but not limited to", and are not intended to (and do not) exclude other components.

Any steps described in this specification may be performed in any order or simultaneously unless stated or the context requires otherwise.

All of the features disclosed in this specification may be combined in any combination, except combinations where at least some of such features and/or steps are mutually exclusive. In particular, the preferred features of the invention are applicable to all aspects of the invention and may be used in any combination. Likewise, features described in non-essential combinations may be used separately (not in combination).

The invention claimed is:

1. A method of injecting ions into an electrostatic trap, comprising:

generating ions in an ion source;

transporting the ions from the ion source to an ion store downstream of the ion source;

releasing the ions from the ion store to a non-trapping ion guide downstream of the ion store; and accelerating the ions from the ion guide as a pulse into an orbital electrostatic trap for mass analysis, wherein the average velocity of the ions as the ions exit from the ion guide is substantially higher than the average velocity of the ions as they exit from the ion store, wherein there is a delay between releasing the ions from the ion store and accelerating the ions from the ion guide such that for ions of the same m/z forming an ion packet, the duration of the ion packet as it enters the electrostatic trap is substantially shorter than when the ion packet enters the ion guide from the ion store.

2. The method as claimed in claim 1 wherein the electrostatic trap separates the ions along a direction z according to their mass-to-charge ratio; and the initial velocity of the ions in the ion guide in the direction z prior to acceleration is substantially smaller than the velocity of the ions in the direction z during ion detection in the electrostatic trap.

3. The method as claimed in claim 2 wherein the ions are accelerated from the ion guide to the electrostatic trap either:

a. substantially in the same direction as the ions were released from the ion store, which is a direction substantially orthogonal to direction z; or b. along a direction that is substantially orthogonally to the direction in which the ions were released from the ion store and is substantially parallel to direction z.

4. The method as claimed in claim 1 wherein the ions are transported from the ion source to the ion store via at least one ion optical device.

5. The method as claimed in claim 1 further comprising separating the ions according to mass-to-charge ratio or ion mobility upstream of the ion store.

6. The method as claimed in claim 1 wherein the ion store is a linear or 3D RF ion trap.

7. The method as claimed in claim 1 wherein the ion store is gas-filled, optionally to a pressure $1 \times 10^{-3}$ mbar to $5 \times 10^{-3}$ mbar.

8. The method as claimed in claim 1 wherein the ions are slowly released from the ion store to the ion guide with energies less than 1V.

9. The method as claimed in claim 1 wherein the ions are released from the ion store over a period of 10 to 100 microseconds.

10. The method as claimed in claim 1 wherein the ions are released from the ion store by applying a DC voltage pulse to generate an axial field gradient in the ion store.

11. The method as claimed in claim 1 wherein the ion guide is gas-free, optionally wherein the pressure is less than or equal to $10^{-3}$ mbar.

12. The method as claimed in claim 1 wherein the ions are accelerated from the ion guide by applying a DC voltage pulse to generate an axial field gradient in the ion guide, whereby an energy increase of the ions depends on their initial position within the guide.

13. The method as claimed in claim 12 wherein the energy range of the accelerated ions is 1% to 30% of the final energy of the ions in the electrostatic trap.

14. The method as claimed in claim 1 wherein at the same time as applying the axial field gradient, any RF field in the ion guide is switched off.

15. The method as claimed in claim 1 wherein the energy spread of the ions accelerated by the ion guide is significantly smaller than the final energy of the ions within the electrostatic trap, optionally wherein the energy spread of the ions is not more than 30% or not more than 20% or not than 10%, of the final energy of the ions within the electrostatic trap.

16. The method as claimed in claim 1 wherein the ion guide focuses the ions at a focal point within the electrostatic trap and wherein the ions are focused into ion packets that are sufficiently narrow in the z-direction of the electrostatic trap when they pass near one or more detection electrodes of the electrostatic trap so as to maintain coherence of the ion packets during detection.

17. The method as claimed in claim 16 further comprising adjusting the position of the focal point using an ion lens located downstream of the ion guide.

18. The method as claimed in claim 1 wherein the ion guide is a linear RF multipole ion guide, optionally wherein the ion guide axis is substantially orthogonally to the direction z of mass separation in the electrostatic trap.

19. The method as claimed in claim 1 wherein the ion guide is a helical trajectory ion guide wherein the ions move with both axial and rotational motion, optionally wherein the ion guide axis is substantially parallel to the direction z of mass separation in the electrostatic trap.

20. The method as claimed in claim 19, further comprising providing a potential step within the ion guide that reduces the velocity of the ions in the direction z.

21. The method as claimed in claim 19 wherein the ions are accelerated out of the ion guide at a fixed radius to the ion guide axis, which lies parallel to the direction z.

22. The method as claimed in claim 19 wherein after accelerating the ions out of the ion guide by means of applying a DC axial field gradient in the ion guide, a further DC axial field gradient is applied in the ion guide that stays on whilst ions are being detected in the electrostatic trap, wherein the further DC axial field gradient is chosen such that perturbations of an ideal electric field within the electrostatic trap are minimized.

23. The method as claimed in claim 22 wherein the further DC axial field gradient is chosen such that ion oscillations in the EST in the direction z remain as close to harmonic as possible.

* * * * *